US005154799A

United States Patent [19]

Vallius

[11] Patent Number: 5,154,799

[45] Date of Patent: Oct. 13, 1992

[54] METHOD AND DEVICE IN A COMPACT PRESS SECTION OF A PAPER MACHINE FOR REPLACEMENT OF ROLLS AND FABRICS

[75] Inventor: Oiva Vallius, Jyväskylä , Finland

[73] Assignee: Valmet Paper Machinery Inc., Finland

[21] Appl. No.: 703,400

[22] Filed: May 21, 1991

[30] Foreign Application Priority Data

May 22, 1990 [FI] Finland ..... 902537

[51] Int. Cl.[5] ..... D21F 3/04

[52] U.S. Cl. ..... 162/199; 162/200; 162/273; 162/274; 162/360.2

[58] Field of Search ..... 162/272, 273, 274, 358, 162/360.1, 199, 200, 205

[56] References Cited

U.S. PATENT DOCUMENTS 4,608,125 8/1986 Autio ..... 162/360.1
4,657,634 4/1987 Autio ..... 162/360.1
4,919,762 4/1990 Laapotti et al. ..... 162/360.1
5,049,239 9/1991 Autio ..... 162/360.1

*Primary Examiner*—Karen M. Hastings
*Attorney, Agent, or Firm*—Steinberg & Raskin

[57] ABSTRACT

Method and device in a compact press section of a paper machine for replacement of press rolls and fabrics. Above the compact combination of press rolls, there is an open space between the front frame and the rear frame of the press section. By means of this space, the press rolls and the upper fabrics can be replaced by raising and lowering, e.g. by means of a crane mounted on the ceiling. The press roll that forms the second press nip in the press section together with the center roll is supported on an opening and loading mechanism to which hydraulic cylinders are connected, by means of which cylinders both the second nip is loaded with a suitable linear load and the mechanism is pivoted to the open position or positions. The movements of lateral parts of the mechanism are synchronized with each other by means of a connecting part fitted between them.

12 Claims, 4 Drawing Sheets

METHOD AND DEVICE IN A COMPACT PRESS SECTION OF A PAPER MACHINE FOR REPLACEMENT OF ROLLS AND FABRICS

BACKGROUND OF THE INVENTION

In the prior art, various compact and closed press sections are known in which there is a combination of press rolls which form at least three press nips with one another. Such prior art press sections include the applicant's "Sym-Press II" press section and "Sym-Press O" press section (trademarks of Valmet Paper Machinery, Inc.).

In the "Sym-Press II", the press section, the first twin-felt nip is formed between a hollow-faced lower press roll and an upper press-section roll, a suction roll forming the second nip with a smooth-faced center roll of the press, in connection with which center roll a third press nip is further formed.

In a "Sym-Press O" the press section, the first twin-felt horizontal nip is formed between a lower hollow-faced roll and an upper press-section press-section roll, whereupon the web follows the upper fabric as a vertical run into the second nip. The second nip is formed between a hollow-faced press roll, separate from the rolls of the first nip, and a smooth-faced centre roll. A third press nip, provided with a felt, is further formed in connection with said centre roll with a hollow-faced press roll.

In compact press sections, the replacement of rolls and press fabrics is problematic. To solve these problems, the applicant has developed a "QF" press frame (trademark of Valmet Paper Machinery, Inc.) which is disclosed in applicant's published FI patent application Nos. 70,951 and 73,025, as well as in U.S. Pat. Nos. 4,608,125 and 4,699,692. As condensed, in a QF frame, the space placed between the front and rear frame parts and above the press-roll combination has been arranged open or openable so that the upper fabrics and at least the upper press rolls can be replaced quickly and easily by making use of the open or openable space.

In the prior art, "Sym-Press O" press section of the applicant, the hollow-faced press roll of the second nip is supported on a beam construction, which is provided with two L-shaped arms. The lower part of this beam construction is linked in connection with the front frame of the press, and its opposite end is attached, by means of openable joints, in connection with the bearing supports of the center roll of the press. Upon opening the joints, the beam construction can be pivoted to the open position when the first upper fabric and the press rolls are being replaced. The beam construction is arranged to be opened and closed by means of a pair of hydraulic cylinders. A second set of support arms is linked with the beam construction. The hollow-faced press roll of the second nip is mounted on the second set of support arms. The second set of support arms are loaded by means of a particular pair of hydraulic cylinders, by whose means the linear load in the second nip against the center roll is produced. The center roll is mounted on fixed supports.

In the prior art construction for loading and opening of a press roll described above, there are two pairs of arms placed one inside the other as well as two pairs of hydraulic actuators, one for opening of the construction and the other one for loading of the nip. Moreover, underneath the press roll the second nip, there is a separate splash plate, which protects the upper press roll from splashes coming from the suction roll placed underneath. This splash plate must be lifted out of its place of operation separately in connection with replacement of roll.

The prior art support construction described above is mechanically complicated and expensive, and it includes a great number of articulated joints and hydraulic actuators. Also, the support construction is susceptible of vibrations. In the support construction, replacement of the lower and upper felts of the first nip is quite complicated, because four separate disassembling operations are required in connection with the replacement of two felts. This increases the costly standstill time required for replacement of felts.

SUMMARY AND OBJECTS OF THE INVENTION

In view of the above, an invention is to provide new solutions for the problems discussed above, so that said drawbacks are largely avoided.

It is a particular object of the invention to provide a method and a device by whose means the constructions of the mechanisms of opening and loading of the second nip in a compact press section can be made remarkably simpler and less expensive and less susceptible of vibration, compared with prior art equipment.

It is a particular object of the invention to provide such a mechanism and method for opening and loading of the second nip in a compact press section by whose means replacement of the first upper fabric as well as replacement of the press rolls are quicker, so that the standstill times required by the replacements become shorter.

It is a further object of the invention to provide such a method and device of the sort concerned during whose application the point of the pivot shaft of the mechanical drive of the press roll of the second nip in the press section performs a movement as little as possible when the second nip is opened.

A further object of the invention is provided a method and device of the type wherein the second nip in the press section can be loaded uniformly and opened in such a way that the hollow-faced press roll in the second nip moves while retaining its alignment when the second nip is being opened and closed, because a cross-wise positioning of the rolls is highly undesirable.

It is a particular object of the invention to provide such a method and device by which a new press roll for the second nip in the press section, which roll is either a variable-crown roll, a grooved roll, but, as a rule, not a suction roll, can be introduced at two different opened positions of the support and loading mechanism.

In view of achieving the objects stated above and others, the method of the invention is related to a compact combination of rolls, above which there is an open space or a corresponding openable space between the front frame and the rear frame of the press section. By means of this space, at least the upper press rolls and the upper fabrics can be replaced by raising and lowering substantially directly, e.g. by means of a crane mountable on the ceiling. The press roll that forms the second press nip in the press section together with the smooth-faced center roll is supported on such an opening and loading mechanism to which actuators, such as hydraulic cylinders, are connected, by means of which actuators both the second nip is loaded with a suitable linear load and said mechanism is pivoted to the open position or positions. The movements of the lateral parts of said mechanism are synchronized with each other by means of a connection part fitted between them. The opening and loading mechanism can be locked in the open position or open positions.

The present invention is also related to a compact press section of a paper machine, wherein the second nip is provided with a mechanism for opening and loading of its press roll, by means of which mechanism the second nip is loaded with a suitable linear load against the smooth-faced center roll of the press and by means of which mechanism the second nip is opened for replacement of the press roll or press rolls and of the press fabric or fabrics.

The opening and loading mechanism comprises side frames at the operating side and at the driving side of the paper machine, to which side frames the bearing supports of the press roll of the second nip are fixed and which side frames are, at their upper part, attached by means of articulated joints in connection with the front frame part of the press or with its projection part, that said side frames are interconnected by means of rigid connecting beam, and that to said side frames, actuators, preferably hydraulic cylinders, are connected, by means of which the second nip is both loaded and opened and closed.

In the invention, the curved movements of the ends of the press roll in the second nip are synchronized with one another by means of a connection beam.

An important aspect of the invention is that the mechanism for opening and loading of the second nip comprises one set of pivot joints only, one joint at the driving side of the machine and the other one at the operating side.

The mechanism for opening and loading of the second nip in the invention is not at all supported by joints on the bearing supports or equivalent of the center roll, so that, for replacement of fabrics or rolls, it is not necessary to disassemble joints. In this way, more space is provided for replacement of rolls.

BRIEF DESCRIPTION OF THE DRAWINGS

In the following, the invention will be described in detail with references to some exemplifying embodiments of the invention illustrated in the figures in the accompanying drawings. These drawings are not intended to limit the claims.

DETAILED DESCRIPTION OF THE PREFERRED EMBODIMENTS

Figure 1:
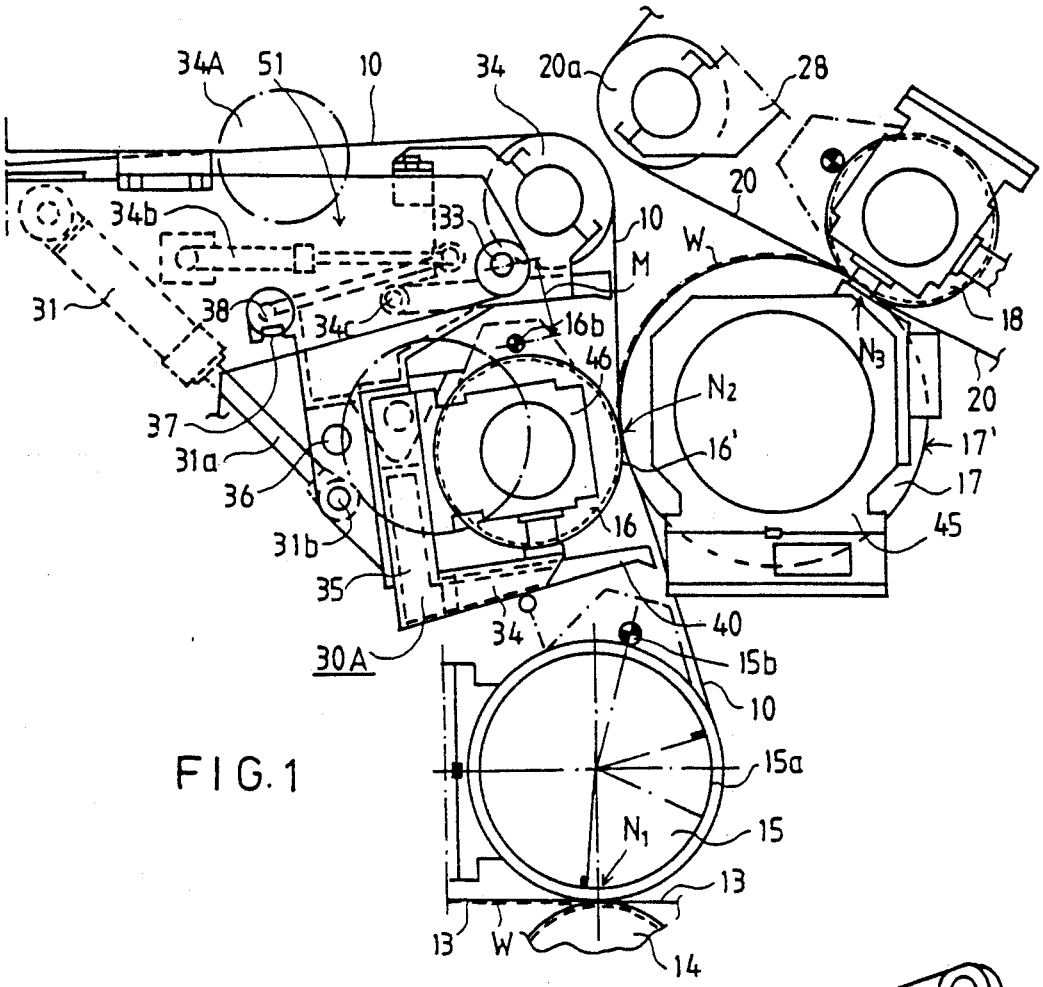
FIG. 1 is a schematic side view of an opening and loading mechanism in accordance with the invention and of a compact press roll combination fitted in connection with said mechanism.

The frame construction of a "Sym-Press O" press section shown in FIGS. 1, 3, 4 and 5 comprises a front frame part 50*a*, an intermediate frame part 50*b* and a rear frame part 50*c*. As it shows in FIGS. 3–5, between the front frame part 50*a* and the rear frame part 50*c* there is an open space T, which is utilized in replacement of the fabrics 10 and 20 and of the press rolls 15, 16, 17 and 18. The space T does not necessarily have to be permanently open, but the frame parts 50*a* and 50*c* can be interconnected by their top portions, e.g. by means of an intermediate frame part, one of whose ends is linked pivotally, e.g., with the rear frame part 50*c*, whereas the other end can be locked by means of instant joints with the top portion of the front frame part 50*a*. Between the front frame part 50*a* and the rear frame part 50*c*, it is also possible to employ telescopic constructions, in which connection beams are displaced in their longitudinal directions linearly in the machine direction between an opened position and a closed position. Also, the articulated joints of pivotal intermediate frame parts can be either horizontal or vertical.

In connection with the front frame part 50*a*, there is a first upper fabric 10, on which the paper web W to be dewatered in the press section is brought from the forming wire 11, by means of the suction zone 12*a* on the pick-up roll 12, into the first and the second nips $N_1$ and $N_2$. The web W is transferred on the lower face of the fabric 10 into the first nip $N_1$, which is formed between a hollow-faced lower press roll 14 and an upper press-section roll 15 and through which nip a lower fabric 13 runs. After the first nip $N_1$, by the effect of the suction zone 15*a* on the suction roll 15, the web W follows the first fabric 10 and passes on the vertical straight run of the fabric 10 into the second nip $N_2$. The second nip $N_2$ is formed between a hollow-faced press roll 16 and the smooth face 17' of center roll 17 of the press.

Figure 3:
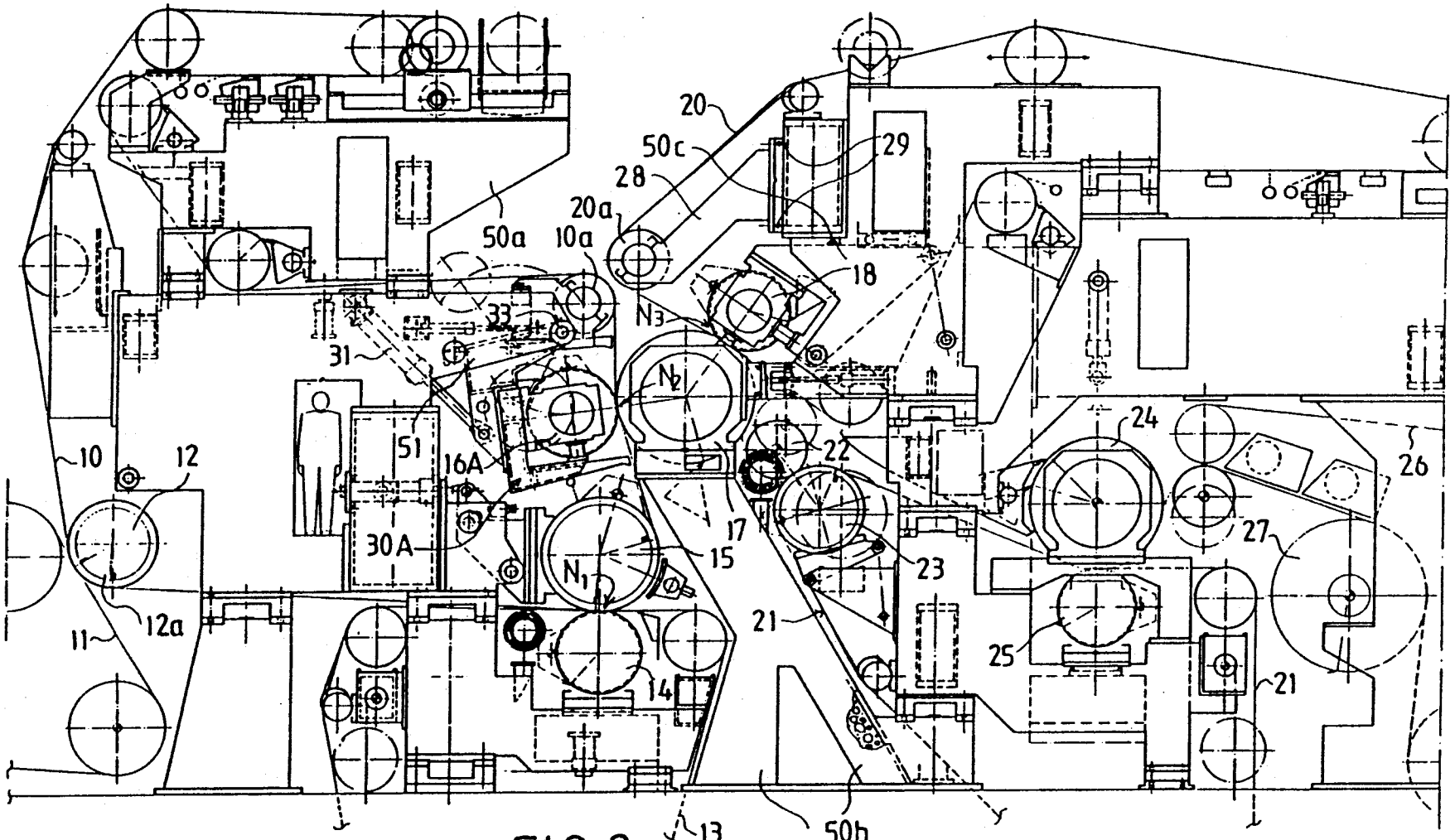
FIG. 3 is a side view of a "Sym-Press O" press section while the press is operative.
Figure 4:
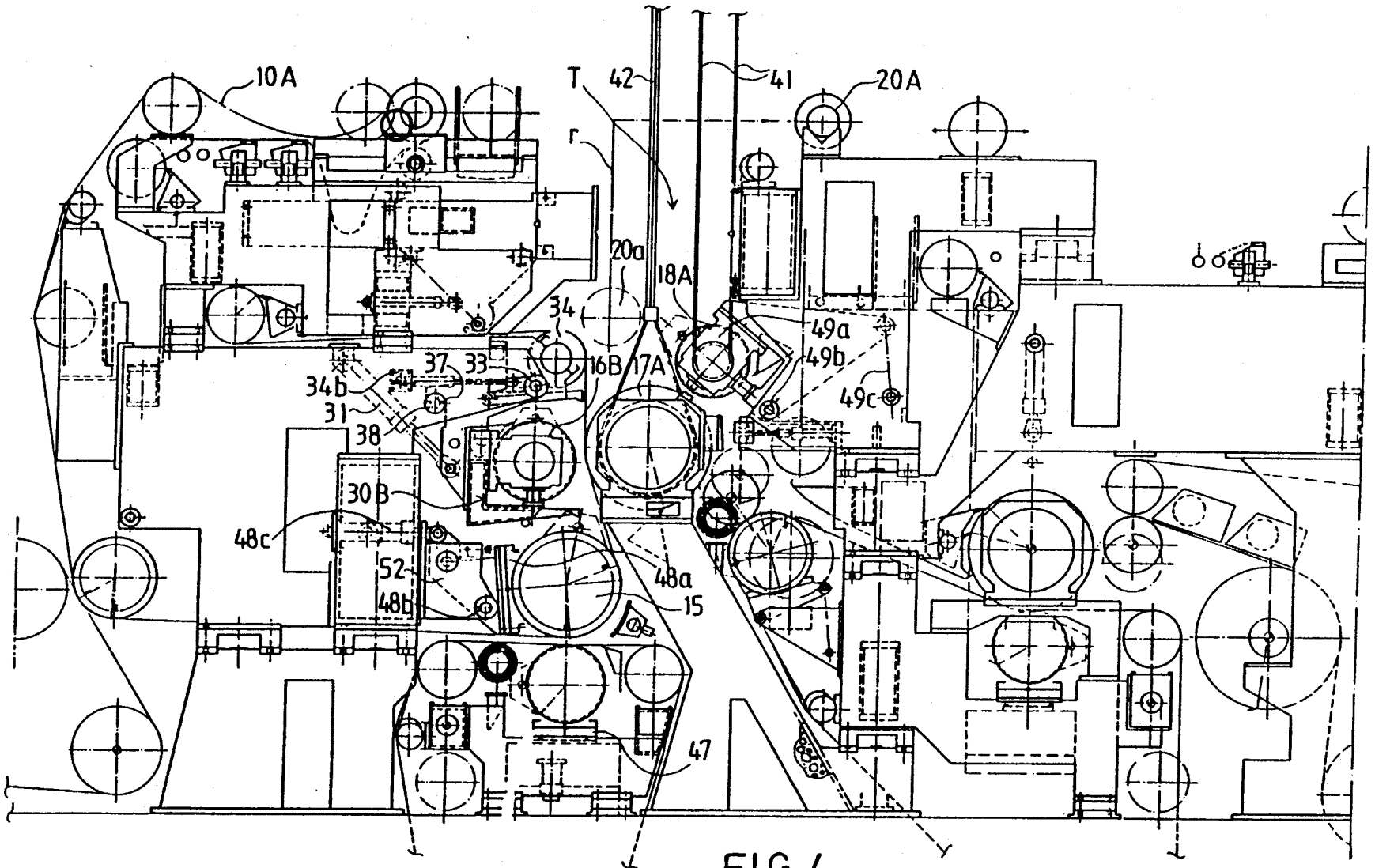
FIG. 4 shows a "Sym-Press O" press section in a way corresponding to FIG. 3 while the second nip has been opened into a first position by means of a mechanism in accordance with the invention.
Figure 5:
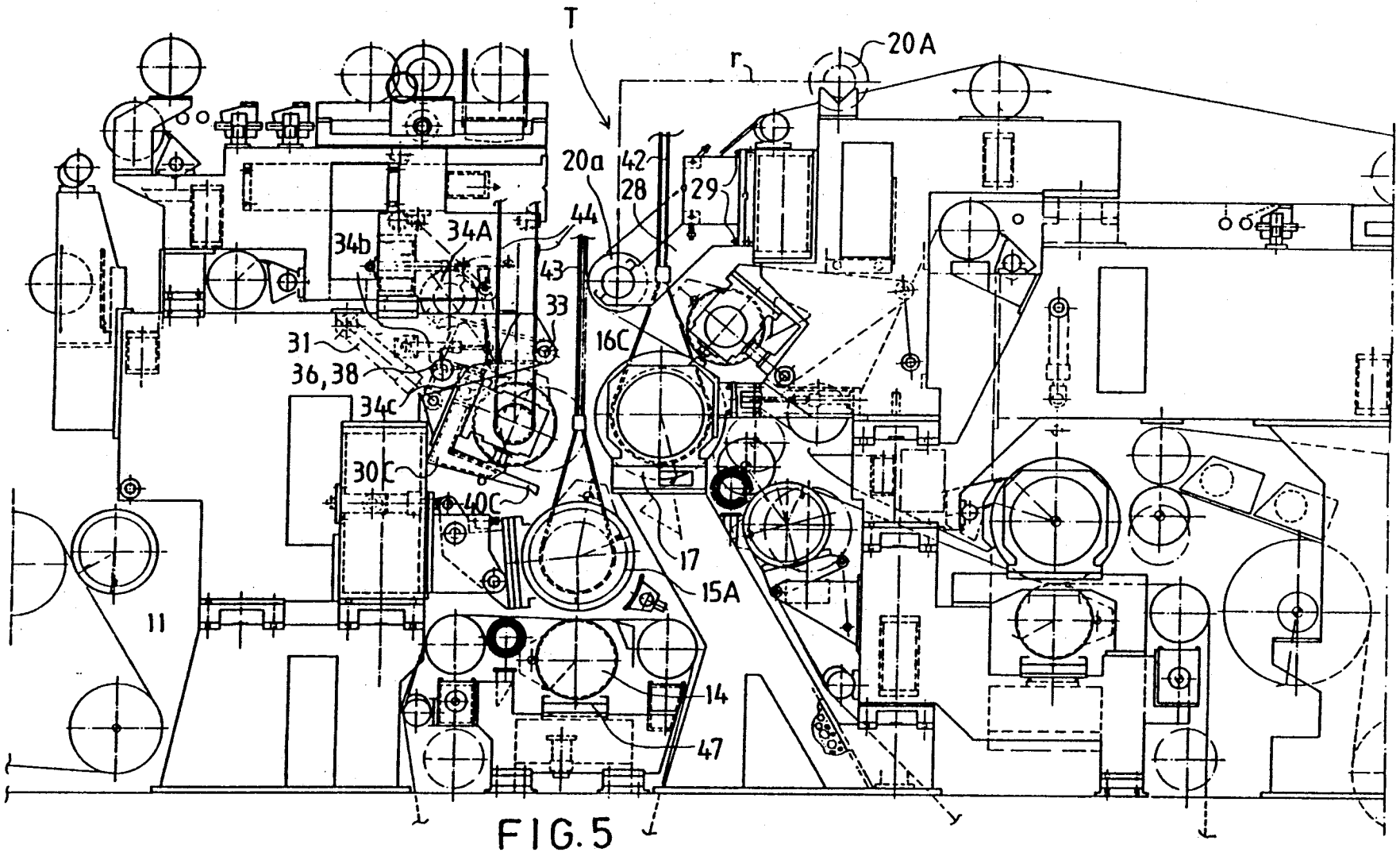
FIG. 5 shows a press section and a mechanism in accordance with the invention in accordance with the invention in a way corresponding to FIGS. 3 and 4 and when opened into a second, extreme open position.

As shown in FIGS. 3, 4 and 5, the suction roll 15 is supported on bearing supports 48*a*, which are connected to the projection part 52 of the front frame 50*a* by means of articulated joints 48*b*. The first nip $N_1$ can be loaded and opened by means of hydraulic cylinders 48*c* fitted between the front frame 50*a* and the bearing supports 48*a*.

After the nip $N_2$, adhering to the smooth face 17' of the centre roll 17, the web W follows along with said roll face into the third nip $N_3$, which is formed between the centre roll 17 and the hollow-faced press roll 18. Through the third nip $N_3$, the second upper fabric 20 runs, whose guide roll, which is placed above the roll combination, is denoted with the reference numeral 20*a*. The press roll 18 is mounted on bearing supports 49*a*, which are connected to the rear frame 50*c* by means of articulated joints 49*b*. The third nip $N_3$ can be opened and loaded by means of hydraulic cylinders 49*c*.

As shown in FIG. 3, after the third nip $N_3$, the web W is detached from the center roll 17 and, being guided by the guide roll 22, is transferred onto the transfer-suction roll 23, over which the lower fabric 21 runs. On said fabric 21, the web W is transferred into the separate fourth nip $N_4$ of the press section, said nip being formed between the upper smooth face 24' of roll 24 and the lower hollow-faced roll 25. From the roll face 24, the web W is detached and transferred onto the drying wire 26, which carries the web W into a multi-cylinder dryer, whose first drying cylinder is denoted with the reference numeral 27.

The construction of a press section described above is mainly known in prior art, and its principal features are described herein as a background of the invention only.

In the following, mainly with reference to FIGS. 1 and 2, an exemplifying embodiment of the construction of an openable support and loading mechanism in accordance with the invention for a hollow-faced 16' press roll 16 will be described.

For opening of the second nip $N_2$, its hollow-faced roll 16 can be shifted from the position 16A into an open position, of which there are two positions, i.e. the position 16B shown in FIG. 4 and the position 16C shown in FIG. 5. The center roll 17 is mounted on fixed bearing supports 45 on the intermediate frame part 50*b*. The mechanism 30 of opening and loading of the press roll 16, which mechanism will be called support mechanism in the following for the sake of conciseness, comprises bearing supports 46.

Figure 2:
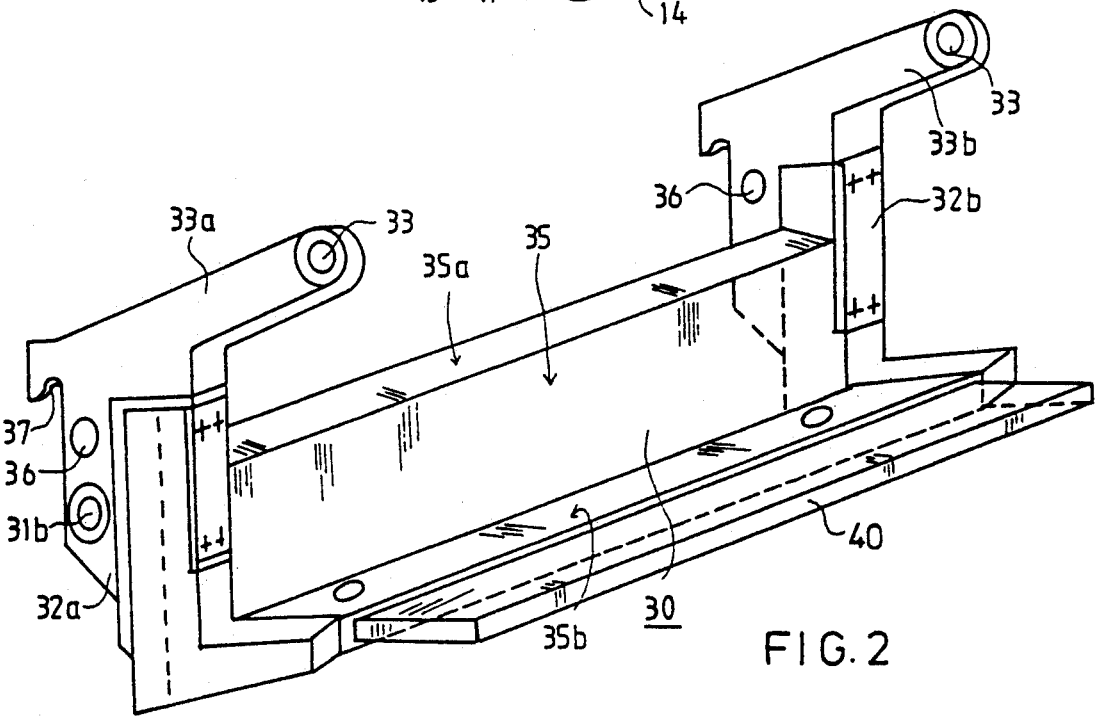
FIG. 2 is an axonometric view of a synchronization beam construction employed in the mechanism in accordance with the invention.

Referring to FIG. 2, the bearing supports 46 are attached to the side frames 32*a* and 32*b* of the support mechanism 30. The mechanism 30 is linked by the ends of the projection parts 33*a*, 33*b* of the side frames 32*a*, 32*b*, by means of the articulated joints 33, in connection with the projection part 51 of the front frame part 50*a*. The mechanisms 30 includes an L-section connection beam 35, which consists of a vertical part 35*a* and a horizontal part 35*b*, which are fixed between the side frames 32*a* and 32*b*. In the way described above, a rigid support mechanism 30 is formed.

The support mechanism 30 is pivoted around articulated joints 33 by means of a pair of hydraulic cylinders 31, one of the cylinders being placed in connection with the side frame 32*a* and the other one in connection; with the other side frame 32*b*. The piston rods 31*a* of the pair of hydraulic cylinders 31 are linked in connection with the side frames 32*a* and 32*b* by means of articulated joints 31*b*. To the outer side of the horizontal part 35*b* of the connecting beam 35, a splash plate 40 is attached, which is placed above the suction roll 15 and gives protection against splashes coming from said roll. The suction roll 15 is driven by its axle journal 15*b* by means of a gearbox. In a corresponding way, the press roll 16 is driven by its axle journal 16*b*. In a preferred embodiment, the axle journal 16*b* is placed as close as possible (distance M) to the articulation point 33, so that the point of the axle journal 16*b* moves as little as possible when the support mechanism is pivoted and when the second nip $N_2$ is opened, in order that it should be possible to drive and rotate the roll 16 in all of its positions 16A,16B,16C.

FIG. 3 shows the operation position of the press section, wherein the nips $N_1$, $N_2$, $N_3$ and $N_4$ dewater the web W and are closed as well as loaded with certain linear loads by means of their actuators.

A fourth nip $N_4$ is not always necessary, but the web W may be passed from the center roll 17 directly to the drying section. The support mechanism 30 in accordance with the invention is in the position 30A shown in FIGS. 1 and 3, wherein the nip $N_2$ is loaded by the pair of hydraulic cylinders 31.

FIG. 4 shows the support mechanism 30 in its first, slightly opened position 30B, wherein the nip $N_2$ is open and the roll 16 in the position 16B. The transfer between the positions 16A and 16B takes place by means of the pair of hydraulic cylinders 31 by pivoting the support mechanism 30. The support mechanism 30 can be locked in its position 30B shown in FIG. 4. This locking takes place by means of the pins 38, which support the mechanism 30B by their intermediate slots 37.

In the position shown in FIG. 4, the center roll 17 can be replaced by means of a pair of lifting cables 42 and a ceiling crane through the open space T between the frame parts 50*a* and 50*c* after the guide roll 20*a* of the second upper fabric 20 has first been passed along the route r to its parking site into the position 20A. In this connection, the support arms 28 of the guide roll 20*a* have also been removed by opening of their instant joints 29. The foremost guide roll 34 of the first upper fabric 10 is attached to a pivoting part, which is attached to the front frame part 50*a* by means of articulated joints 34*c*.

As shown in FIG. 5, the foremost guide roll 34 has been shifted out of the way of roll replacement into an inner position 34A by means of a hydraulic cylinder 34*b*. If the front frame part 50*a* and the rear frame part 50*c* are attached to one another by means of connecting beams, these beams are pivoted or shifted away so that the space T is opened above the combination of rolls 15, 16, 17, 18. The replacement of the press roll 16 can be carried out in both of the positions 16B and 16C. As is shown in FIG. 5, the roll 16C is supported and lifted by means of the cables 44 of the crane.

As shown in FIG. 4, the upper roll 18A of the third nip $N_3$ can also be replaced by means of the lifting cables 41 and the ceiling crane (not shown) in the paper machine hall. In the position shown in FIG. 4, the first upper fabric 10A and the second upper fabric 20 can also be replaced, the latter fabric 20 being illustrated as having been removed in FIG. 4.

FIG. 5 shows the second open position 30C of the support mechanism 30, in which the position is fully opened, in which case the press roll 16 is in the position 16C. In this position 30C of the support mechanism 30, the suction roll 15*a* of the first nip $N_1$ can be replaced by means of the ceiling crane by making use of the pair of lifting cables 43 after the center roll 17 has first been replaced by means of a pair of lifting cables 42. Before this, the support arms 28 of the roll 18 have been removed, and the guide roll 20*a* has been shifted along the route r to its parking site 20A. The lower press roll 14 in the first nip $N_1$, which is mounted on fixed bearing supports, can be replaced by means of a carriage 47 by shifting the roll in its axial direction and by supporting and shifting the outer end of the roll 14, placed at the operating side, by means of a cable attached to a crane.

The mechanism 30 is supported in the open position 30C shown in FIG. 5 by means of holes 36 provided in connection with its side frames 32*a* and 32*b* and with the frame part 51 and by means of the locking pins 38 when said holes are in alignment with one another. At the same time as the support mechanism 30 is shifted and locked into the fully opened position 30C shown in FIG. 5, the splash plate is also shifted to the position 30C, in which it is not in the way for replacement of the suction roll 15*a*.

The description of the preferred embodiments provided above is not meant to be exclusive. Many other variations of the present invention would be obvious to those skilled in the art, and are contemplated to be within the scope of the appended claims.

I claim:

1. A method for the replacement of press rolls and fabrics in compact press section of a paper machine having a front frame and a rear frame, wherein the press rolls form a compact combination of rolls with at least three press nips, a second press nip is formed in he press section by a press roll and a smooth-faced center roll, and above the press section there is an open space for a corresponding openable space between said front frame and said rear frame of the press section, by means of which space at least the upper press rolls and the upper fabrics can be replaced by raising and lowering substantially directly by means of a crane mounted on the ceiling, comprising supporting said press roll of said second press nip on an opening and loading mechanism which is provided with lateral parts linked to said front frame, connecting actuators to said opening and loading mechanism such that said actuators function to load said second nip with a suitable linear load against said smooth-faced center roll and such that said actuators function to pivot said opening and leading mechanism to one or more open positions, synchronizing the movements of said lateral parts of said opening and loading mechanism with each other by means of a connecting part fitted between them, and locking said opening and loading mechanism in a partly opened position for replacement of an upper first fabric, and locking said opening and loading mechanism in a fully opened position for replacement of a press roll or rolls.

2. The method of claim 1, wherein a suction roll is located below said opening and loading mechanism, further comprising locking said opening and loading mechanism in said fully opened position and replacing said suction roll by raising said suction roll and lowering a new suction roll substantially directly.

3. The method of claim 2, wherein said opening and loading mechanism further comprises a splash-shield plate located above said suction roll to provide protection against splashes coming from said suction roll, further comprising shifting said splash-shield plate out of the said open or openable space during the replacement of a roll when said opening and loading mechanism is pivoted into said fully open position.

4. The method of claim 1, wherein said press section further comprises a guide roll for a second upper fabric provided with supporting arms connected to said rear frame, said guide roll located above said center roll, further comprising shifting said guide roll along a guide path to a parking site and detaching and/or pivoting said supporting arms out of said open or openable space during replacement of said center roll.

5. The method of claim 2, further comprising removing said press roll of said second nip by means of lifting cables, and introducing a new press roll into its position in any of the opened positions of said opening and loading mechanism.

6. The method of claim 1, wherein said actuators comprise hydraulic cylinders.

7. A compact press section of a paper machine, comprising a front frame and a rear frame, a plurality of press rolls forming a compact combination of rolls with at least three press nips, a second press nip being formed in the press section by a press roll and a smooth-faced center roll, said press section being provided with an open space or a corresponding openable space between said front frame and said rear frame of the press section, by means of which space at least the upper press rolls and the upper fabrics can be replaced by raising and lowering substantially directly by means of a crane mounted on the ceiling, an opening and loading mechanism supporting said press roll of said second press nip, said opening and loading mechanism providing said second nip with a suitable linear load against said smooth-faced center roll and being pivotable to one or more open positions for replacement of one or more press rolls and/or one or more press fabrics associated with said press section, said opening and loading mechanism being provided with lateral parts at an operating side and at a driving side of said paper machine, said press roll of said second nip being provided with bearing supports fixed to said lateral parts, said lateral parts being interconnected by means of a rigid connecting beam, articulated joints connected to said front frame or to a projection part of said front frame, said lateral parts having upper parts attached to said articulated joints, and actuators connected to said upper parts of said lateral parts, said actuators being structured and arranged to both load said second nip with a suitable linear load against said smooth-faced center roll and to move said opening and loading mechanism to one or more open positions, said opening and loading mechanism being structured to be pivoted and locked in a partly opened position for replacement of an upper first fabric, and said opening and loading mechanism being structured to be pivoted and locked in a fully opening position for replacement of a press roll or rolls.

8. The press section as claimed in claim 7, further comprising a foremost guide roll of a first press fabric and located above said opening and loading mechanism, said foremost guide roll being mounted on an intermediate frame of said press section, said foremost guide roll being pivoted by means of said actuators to an inner position out of the said open or openable space for replacement of a press roll or rolls.

9. The press section as claimed in claim 7, wherein said opening and loading mechanism is locked by means of locking pins and locking holes.

10. The press section of claim 7 further comprising a suction roll located below said opening and loading mechanism, wherein said opening and loading mechanism is pivoted and locked in said fully opened position and said suction roll replaced by raising said suction roll and lowering a new suction roll substantially directly.

11. The press section of claim 10, wherein said opening and loading mechanism further comprises a splash-shield plate located above said suction roll to provide protection against splashes coming from said suction roll, further comprising shifting said splash-shield plate out of the said open or openable space during the replacement of a roll when said opening and loading mechanism is pivoted into said fully open position.

12. The press section of claim 7, further comprising a guide roll for a second upper fabric provided with detachable or pivotable supporting arms connected to said rear frame, said guide roll located above said center roll and provided with a guide path for shifting said guide roll to a parking site during replacement of said center roll.

* * * * *